United States Patent [19]

Merry

[11] Patent Number: 4,502,406

[45] Date of Patent: Mar. 5, 1985

[54] ROLLER TRAVELER ASSEMBLY

[75] Inventor: Carl A. Merry, Marion, Mass.

[73] Assignee: Schaefer Marine, Inc., New Bedford, Mass.

[21] Appl. No.: 406,551

[22] Filed: Aug. 9, 1982

[51] Int. Cl.[3] ..... B63H 9/10

[52] U.S. Cl. ..... 114/204; 114/108; 114/112

[58] Field of Search ..... 114/204, 205, 218, 220, 114/112, 39, 108; 105/154; 104/95, 107, 247, 244

[56] References Cited

U.S. PATENT DOCUMENTS

| | | | |
|---|---|---|---|
| 1,695,673 | 12/1928 | Wilson | 114/112 |
| 2,561,253 | 7/1951 | Wells-Coates | 114/112 |
| 2,869,709 | 1/1959 | Zebley | 104/95 |
| 3,326,170 | 6/1967 | Lewery | 114/204 |
| 3,623,445 | 11/1971 | Holmes | 114/204 |
| 4,147,121 | 4/1979 | Fogh et al. | 114/204 |
| 4,147,122 | 4/1979 | Merry | 114/204 |

FOREIGN PATENT DOCUMENTS

| | | | |
|---|---|---|---|
| 256360 | 8/1926 | United Kingdom | 114/112 |
| 979339 | 1/1965 | United Kingdom | 114/204 |

*Primary Examiner*—Trygve M. Blix
*Assistant Examiner*—Patrick W. Young
*Attorney, Agent, or Firm*—Cesari and McKenna

[57] ABSTRACT

A traveler assembly for a boat includes a rigid track defining a pair of spaced-apart channels on opposite sides of the track. A car with side wheels rides on the track with its wheels engaging in the channels. The car wheels have rounded peripheral cross sections which ride on conforming upper and lower rails formed by the channels to provide maximum surface engagement and minimum parts wear as the car rolls back and forth along the track. Resultantly, the car travels readily and quietly even when subjected to high vertical and lateral loads.

4 Claims, 4 Drawing Figures

ROLLER TRAVELER ASSEMBLY

This invention relates to marine hardware and, in particular, to a roller traveler assembly.

BACKGROUND OF THE INVENTION

A traveler assembly is employed on a sailboat to provide a movable anchoring point for a block, cleat or other marine hardware item. For example, a traveler assembly is often mounted transversely near the stern of the boat to anchor a block controlling the main sheet. Such a traveler assembly may also be used to control the leech and foot tension of a genoa when the genoa is set and drawing under load.

The usual traveler assembly includes a track or slide that is secured to the boat structure and a car that rides on the track. The block or other marine fixture is secured to the top of the car. On smaller sailboats, the car component of the assembly may simply be a key or slider which slides in a keyway or slide defining the track. However, on larger boats, particularly cruisers and racing craft whose traveler assemblies are subjected to very high vertical and lateral loads, a larger, much more rugged, mechanically complex assembly is utilized.

In the latter type of traveler assembly of interest here, the track is in the form of an extruded member having a cross-sectional shape which makes it quite rigid and which defines flat rails on which the car can ride. The cross sections of some tracks are X-shaped and some are I-shaped. The traveler car is fitted with wheels having flat peripheries and which roll along the rails defined by the track. For example, in the traveler assembly incorporating an I-shaped track, the car straddles the track and its wheels engage the upper and lower arms of the I at opposite sides of the track. The car associated with the X-shaped traveler track also straddles the track and is fitted with wheels which engage under rails defined by the upper arms of the track.

There also exists an assembly with a modified X-shaped track whose lower arms splay out sideways beyond the upper arms, thereby defining a pair of lower rails which are also engaged by the car wheels. When the car is subjected to compression loads, the car wheels roll along the lower rails and, when the car is placed under tension, the wheels roll along the upper rails defined by the track.

In many traveler assemblies, the tracks are bent horizontally or vertically to some extent either intentionally to conform to the structures to which they are anchored or due to distortion caused by the heavy loads applied to them. Therefore, the cars must fit relatively loosely on such tracks to ensure that they can travel from end to end despite such bends. Some prior assemblies are disadvantaged because, when they are subjected to relatively high side loads, their cars, being loosely fitted to the track as aforesaid, cock to such an extent that they scrape or chafe against their tracks as they move along the tracks. This causes noise and excessive parts wear. Also, of course, such scraping inhibits the motion of the car along the tracks.

Furthermore, the rail and the wheel surfaces in the prior assemblies usually achieve point contact. Consequently, when a car cocks due to a side load, the peripheries of its wheels are no longer flush with the rail surfaces and the entire side load is transmitted to the rails at the edges of the wheels. Therefore, after only a relatively short time, the wheel edges tend to wear grooves in the rails or become worn themselves thereby loosening the fit between the car and the track. That, in turn, promotes even more chafing, parts wear and interferes generally with the proper operation of the traveler assembly.

The traveler assembly described above employing the modified X-track is able to handle side loads applied at angles of up to 180°. However, in order to do this, it has an unusually wide cross section so that it takes up a relatively large amount of space on the boat and requires a proportionately wider bridge if it is mounted on such a bridge extending over a companionway, for example. Furthermore, the track in that particular prior assembly cannot be bent either in the vertical or the horizontal direction. Therefore, it has to be mounted on a perfectly straight flat surface if it is to operate properly.

SUMMARY OF THE INVENTION

Accordingly, the present invention aims to provide an improved traveler assembly for a sailboat.

Another object of the invention is to provide a traveler assembly which is rugged and operates reliably even after a prolonged period of use.

A further object of the invention is to provide an assembly of this type which is able to operate properly under the very high side loads encountered on large sailing craft.

Still another object of the invention is to provide a traveler assembly which suffers a minimum amount of parts wear in use.

Another object of the invention is to provide an assembly of this type which operates properly even though its track is curved to some extent.

Yet another object of the invention is to provide a traveler assembly whose car does not chafe or scrape the track even under high side load conditions.

Other objects will, in part, be obvious and will, in part, appear hereinafter.

The invention accordingly comprises the features of construction, combination of elements and arrangement of parts which will be exemplified in the following detailed description, and the scope of the invention will be indicated in the claims.

Briefly, my traveler assembly comprises a rail-defining track and a wheeled car which is mounted on the track with its wheels engaging the rails and which can be rolled back and forth along the track as needed when the boat is under sail. The assembly track has a cross-sectional shape which is aptly characterized as I-shaped. It differs from the I-shaped tracks in prior assemblies, however, in that the upper and lower arms of the I constitute rails which are specifically contoured to mate with car wheels which are themselves rounded. Consequently, a maximum amount of wheel surface contacts the rails as the car moves along the track even though the car is cocked to some extent under a side load condition.

The traveler car has the cross-sectional shape of an inverted U whose legs are splayed out somewhat. Wheels are rotatively mounted to the opposite sides of the car so that the wheels project toward one another in positions to engage the opposite contoured track rails.

The block or other marine fitting carried by the car is anchored to the car by threaded fasteners turned down into threaded holes provided in the bridging portion of the car. Alternatively, that bridging portion may be formed with a lengthwise key or keyway for interlocking with a mating element attached to the block.

Normally, the car wheels roll along the bottom pair of rails defined by the track. However, when an upward force is applied to the car, the car is lifted up relative to the track so that its wheels engage the upper pair of rails defined by the track. On the other hand, when a side load is applied to the car, the car is cocked so that the wheels at one side of the car engage and roll along the upper rail at that side of the track, while the wheels on the opposite side of the car roll along the corresponding bottom rail. Therefore, all of the car wheels are always in rolling engagement with the rails at opposite sides of the track whatever the direction of the load applied to the car. Consequently, the load is distributed evenly among all of the wheels. This minimizes parts wear and assures that the car will roll freely along the track under all load conditions. Moreover, since the wheels and rails are correspondingly rounded, they engage one another along an arcuate contact line which is longer than the straight contact line of prior wheels. This reduces wheel and rail wear and also minimizes noise as the car rolls along the track.

Also, since the wheels engage both upper and lower track rails when the car is subjected to a side load, the cocking or tilting of the car relative to the track under a side load is kept to a minimum. Therefore, even though there may be only a small clearance between the bridging portion of the car and the top of the track, the car does not scrape or chafe against the track as it rolls along the track.

Moreover, even if the car does tilt to some small extent, since the wheels and rails are in conforming engagement, line contact with the rails is maintained so that no sharp wheel edges are presented to the rails that could score the rails.

The car in the present traveler assembly rolls freely along its track even though the track is bent somewhat in the horizontal or vertical direction. The motion of the car is quiet and smooth even though the car is subjected to the entire range of side loads over a 180° arc. Also the assembly is relatively simple and rugged so that it should have a long useful life. Yet with all of these advantages, the present assembly is not appreciably more expensive to make and install than prior comparable marine hardware items of this general type.

BRIEF DESCRIPTION OF THE DRAWING

For a fuller understanding of the nature and objects of the invention, reference should be had to the following detailed description, taken in connection with the accompanying drawing, in which.

DESCRIPTION OF THE PREFERRED EMBODIMENTS

Figure 1:
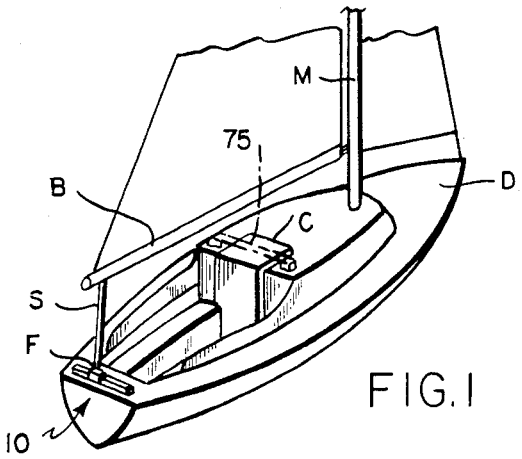
FIG. 1 is a perspective view of a sailboat fitted with a traveler assembly made in accordance with this invention.

Referring first to FIG. 1 of the drawing, a boat D having a mast M and a boom B is fitted with a traveler assembly indicated generally at 10 to which is attached the block F for the main sheet S. Assembly 10 is secured transversely near the stern of the boat and permits the block F to be moved transversely to the boat.

Figure 2:
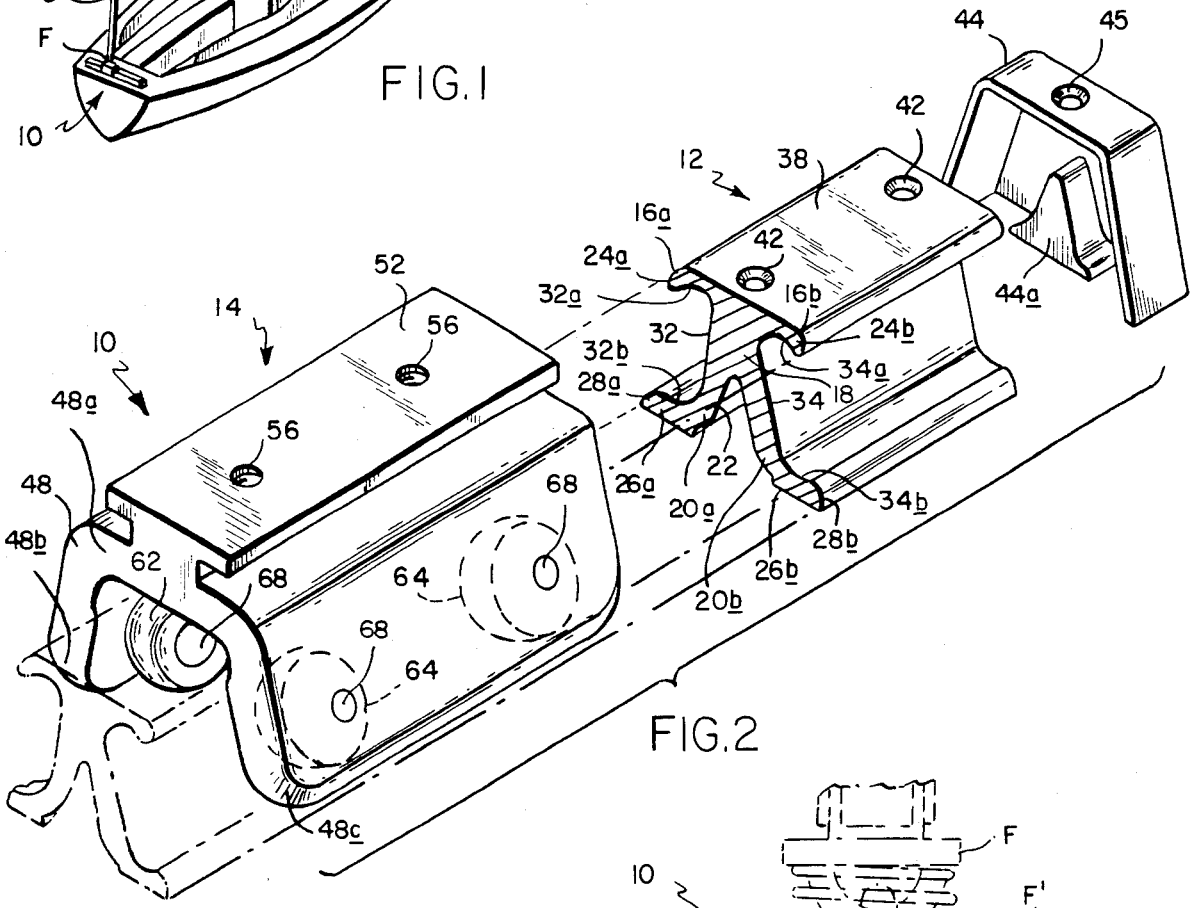
FIG. 2 is an exploded fragmentary perspective view showing the assembly in greater detail.
Figure 3:
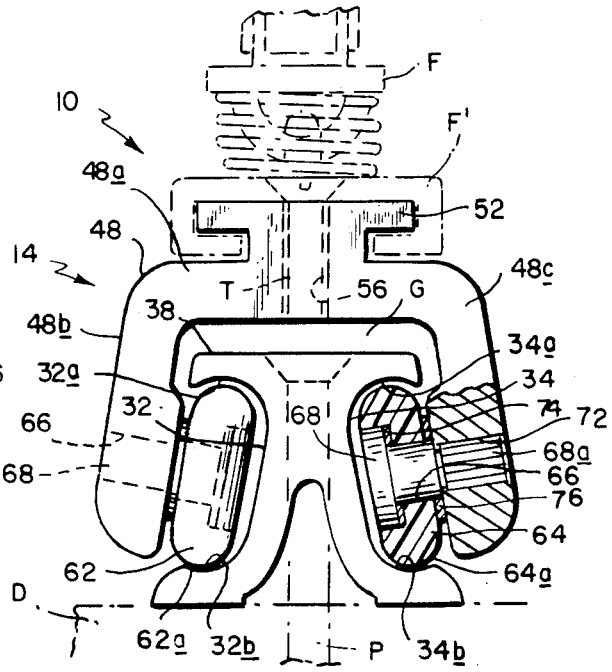
FIG. 3 is an end view of the assembly with parts broken away.

Turning now to FIGS. 2 and 3, assembly 10 comprises a track shown generally at 12 and a car indicated generally at 14 which rolls along the track. Track 12 is an elongated extruded member made of anodized or epoxy-coated aluminum or other comparable salt water-corrosion-resistant material. The track has a cross section which is generally I-shaped. More particularly, the track section has a pair of oppositely-extending shoulders **16*a* and 16*b* which project out laterally on opposite sides of the track. Extending down between those shoulders is a relatively narrow waist 18 which divides to form a pair of legs 20*a* and 20*b*. The legs are splayed or spread apart to define a longitudinal groove 22 whose cross section is shaped more or less like an inverted letter V. The groove 22** is present to save material and to facilitate extrusion of the track. However, it is not essential and in some assemblies may be eliminated so that the track is solid.

The free edges of the shoulders **16*a* and 16*b* extend downward to some extent, forming a pair of longitudinal beads 24*a* and 24*b*. The legs, on the other hand, terminate in a pair of laterally extending feet 26*a* and 26*b* which also extend the entire length of the track. The undersides of the feet are flat so that the track can rest on a flat surface. The upper surfaces of the feet protrude upward to some extent forming a pair of longitudinal ridges or beads 28*a* and 28*b* which are more or less opposite beads 24*a* and 24*b***.

The opposite sides of the waist 18 and legs **20*a* and 20*b*, together with the beads 24*a*, 24*b*, 28*a* and 28*b*, define a pair of mirror-image, generally C-shaped channels 32 and 34 at opposite sides of the track. As best seen in FIG. 3, the two channels are oriented at a small angle (e.g. 10°) relative to the vertical, which angle corresponds more or less to the splay angle of the track legs 20*a* and 20*b*. The upper and lower segments of channel 32 just inboard of the beads 24*a* and 28*a* respectively are arcuate or rounded to define rails 32*a* and 32*b*. Likewise, channel 34 has similarly placed upper and lower arcuate rails 34*a* and 34*b***.

The top surface 38 of the track is generally horizontal and flat. A lengthwise series of spaced-apart vertical passages 42 is located on the longitudinal centerline of the track. These passages, which are countersunk, extend down to the groove 22 at the underside of the track and receive fasteners for anchoring the track to a supporting surface of boat D. One such fastener is shown in dotted lines at P in FIG. 3.

Also, the track 12 can be provided with rubber or plastic end caps or plugs to exclude water from groove 22. One such cap is shown at 44 in FIG. 2. It is generally trapezoidal in shape. It is formed with an interior projection **44*a* shaped to plug into the end of track groove 22. It also has an opening 45 in its top wall which registers with opening 42 at the end of track 12 so that it can be secured to the track by a fastener P (FIG. 3**).

Still referring to FIGS. 2 and 3, the car 14 which rides along track 12 comprises an extruded channel-shaped housing 48 having a top wall **48*a* and a pair of depending side walls 48*b* and 48*c*. The side walls are splayed, being oriented at more or less the same angle as the track channels 32 and 34, i.e. 10°. Car 14 can be made of the same material as track 12**.

Projecting up from the top wall **48*a* is a longitudinal key 52 whose cross section is T-shaped. The marine fitting associated with the traveler assembly is anchored to the car 14 by interlocking with its key 52. For example, there is shown in FIG. 3 in dotted lines a block F having a slide or keyway F′ engaged to key 52. One or more openings 56 are formed through the key and top wall 48***a* at locations spaced along the longitudinal centerline of the car for receiving a threaded fastener by which the slider F′ or other marine fitting can be removably anchored to car 14. One such fastener is shown in dotted lines at T in FIG. 3.

The lower edge margins of the side walls 48*b* and 48*c* are thickened to some extent to support two or more sets of rotary wheels 62 and 64 respectively from those side walls. The sets of wheels 62 and 64 extend toward one another below the car top wall 48*a* and they are set at the same angle as the car side walls. Each wheel is made of a tough wear-resistant material such as polyurethane and each has a peripheral edge 62*a*, 64*a* which is rounded to conform generally to the shape of the rounded rails.

As best seen in FIG. 3, each wheel is formed with an axial counterbored passage 66 for receiving a roller pin 68 whose shaft 68*a* is striated and forcefit into an opening 72 in the car side wall 48*b* or 48*c*. A pair of washers 74 and 76 are positioned around the roller pin at opposite sides of the wheel to ensure the free rotation of the wheel.

When the car 14 is mounted to track 12, its wheels 62 and 64 travel along the channels 32 and 34 respectively with the walls of those channels closely conforming to the wheel envelopes as shown in FIG. 3. Consequently, there can be very little lateral, vertical or cocking movements of the car relative to the track. If the traveler is under compression, the car 14 is pressed downward relative to the track 12 so that its wheels 62 and 64 engage the lower rails 32*b* and 34*b* respectively. On the other hand, if there is an upward force exerted on the car 14, those wheels engage the upper rails 32*a* and 34*a* respectively. A lateral force applied to the car, say to the left as viewed in FIG. 3, tends to cock the car so that the wheels 64 engage the upper rail 34*a* while the wheels 62 are pressed down against the lower rail 32*b*. Of course, a lateral force to the right produces the opposite effect. No matter which way the force is applied to the car, all of the wheels 62, 64 are always engaged with a rail. Therefore, that force is distributed amongst all of the wheels for transmission to the track. As a result, the car is able to roll easily along the track under all of these different load conditions.

Also, as best seen in FIG. 3, an appreciable gap G always exists between the top of track and the underside of the car. Therefore, lateral forces applied up to 90° on each side of the vertical direction will not cause the car to chafe and scrape the track as it moves along the track.

It is important to note also that, when the car 14 is subjected to a side load which causes the car to tilt slightly as its wheels 62 and 64 engage the upper and lower rails respectively, each wheel still contacts its rail along an arcuate line extending around the wheel cross-sectional perimeter because the wheels and rails have conforming curvature. This line contact distributes the load across the width of each wheel and the wheel has no corners that can become worn or tend to inscribe grooves in the track. Therefore, the car continues to roll smoothly and quietly along the track under load even after prolonged usage.

Yet there is sufficient clearance between the car wheels and the track rails such that the car will roll freely under load even though the track is bent somewhat in the vertical or horizontal direction, due either to its conforming to the curvature of the supporting surface or to bending of the track under stress.

In some cases, it may be desirable to mount the traveler assembly on a bridge extending between opposite sides of the boat. For example, the assembly may have to extend over a companionway such as companionway C on the FIG. 1 boat. An arrangement such as this is shown generally in dotted lines at 75 in FIG. 1 and in greater detail in FIG. 4. In this arrangement, the car 14 rides on track 12 as before. The track, however, is mounted to or formed as a rigid longitudinal extruded beam 76. In the embodiment shown in FIG. 4, the beam has the cross-sectional shape, more or less, of an I-beam with a transverse or top wall 76*a* and a pair of spaced-apart depending side walls 76*b*. This I-shaped cross section gives the beam very good rigidity over its entire length. The opposite ends of the beam are mounted at opposite sides of companionway C by suitable brackets (not shown) which are secured to the beam side walls 76*b* and to the boat superstructure.

The upper surface of the beam top wall 76*a* is formed with a dovetail slide or keyway 82 which extends its entire length. The slide is dimensioned so that the track 12 can be keyed to the slide with its foot beads 28*a* and 28*b* engaging under the side walls 82*a* of the slide, which walls are curved to conform to the tops of the beads. The track is installed on the beam by inserting its feet 26*a* and 26*b* into the slide 82 and sliding the track along the slide. The lengthwise position of the track relative to the beam can be maintained by threaded fasteners 84 extending down through one or more openings 42 (FIG. 2) in the track and turned down into registering threaded holes 88 in the beam wall 76*a* as shown in FIG. 4.

Figure 4:
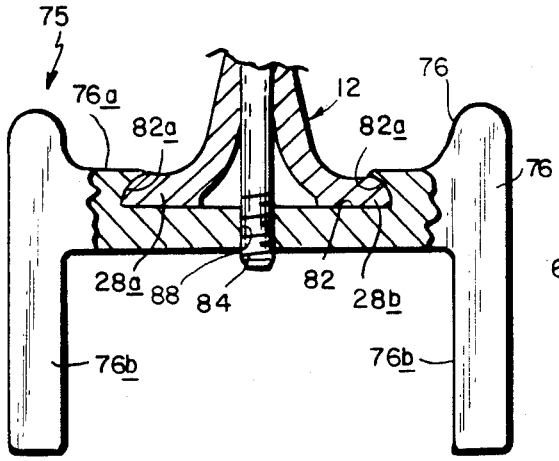
FIG. 4 is a similar view of the assembly mounted on a bridge.

Obviously also, instead of forming track 12 and beam 76 separately, they may be extruded as one piece having the overall exterior shape of the interfitting track and beam depicted in FIG. 4. In other words, that single extrusion would be formed without the track groove 22 and screw openings 42.

It can be seen from the foregoing, then, that my improved traveler assembly is a very strong and rugged marine hardware item. Even when subjected to very high sheet loads exerted vertically or to either side up to angles of 90°, the car 14 is still able to travel readily and quietly along its track 12. Moreover, because of the shapes of the car wheels and the wheel-conforming rail surfaces, such movements take place with a minimum amount of parts wear and noise. Consequently, the traveler assembly should have a long useful life as compared with prior comparable fittings of this general type.

It will thus be seen that the objects set forth above, among those made apparent from the preceding description, are efficiently attained, and, since certain changes may be made in the above constructions without departing from the scope of the invention, it is intended that all matter contained in the above description or shown in the accompanying drawing be interpreted as illustrative and not in a limiting sense.

It is also to be understood that the following claims are intended to cover all of the generic and specific features of the invention herein described.

What is claimed as new and desired to be secured by Letters Patent of the United States is:

1. A traveler assembly comprising

A. track means having (1) means defining a pair of oppositely disposed, laterally open, mirror-image, C-shaped channels (a) extending the length of the track means, and (b) being canted upwardly inwardly at an angle from the vertical, the upper and lower walls of said channels defining upper and lower concave-in-cross-section rails;

(2) means defining a longitudinal groove in the underside of said track means which extend between said channels;

(3) a pair of laterally projecting flanges (a) underlying said channels, and (b) extending along substantially the entire length of the track means; and (4) a cross section which is generally I-shaped with (a) the body of the I being progressively thicker from top to bottom, and (b) the lower arms of the I extending laterally beyond the upper arms thereof; and B. a car, said car including (1) a generally U-shaped rigid member having a top wall and a pair of depending splayed side walls straddling said track means, the splay angle of the side walls being substantially the same as the cant angle of the track means channels;

(2) a slide formed integrally with the rigid member top wall and extending substantially the entire length of that wall for attaching a marine fitting to said top wall;

(3) a plurality of donut-shaped, impact-resistant plastic wheels rotatively mounted to axles anchored in said rigid member side walls at the inboard surfaces thereof so that the wheels can engage in said channels, the peripheries of the wheels being rounded more or less in correspondence with the cross-sectional curvature of said track means upper and lower rails so that, when the car is moved along the track means under vertical or lateral loads transmitted through said slide, said wheels make line contacts with said upper or lower rails; and C. longitudinal bridge means having (1) a top wall;

(2) a pair of side walls depending from the opposite side edges of the top walls; and (3) an upwardly-facing keyway extending along the length of the bridge means top wall for slidably receiving said flanges so that the track means can be supported by the bridge means.

2. The traveler assembly defined in claim 1 and further including

A. a pair of end caps engaged over the opposite ends of the tack means, said caps including projections which plug into and close the opposite ends of said groove; and B. means for removably securing the caps to the track means.

3. The traveler assembly defined in claim 1 and further including means for removably securing the key means against lengthwise sliding motion in the bridge means keyway.

4. A traveler assembly comprising

A. track means having (1) means defining a pair of oppositely disposed, laterally open, mirror-image, C-shaped channels (a) extending the length of the track means, and (b) being canted upwardly inwardly at an angle from the vertical, the upper and lower walls of said channels defining upper and lower concave-in-cross-section rails;

(2) means defining a longitudinal groove in the underside of said track means which extend between said channels;

(3) a cross section which is generally I-shaped with (a) the body of the I being progressively thicker from top to bottom, and (b) the lower arms of the I extending laterally beyond the upper arms thereof;

(4) a pair of laterally projecting shoulders (a) underlying said channels, and (b) extending along the entire length of the track means; and (5) a pair of side walls depending from the side edges of said shoulders so as to form a rigid bridging frame member so that the track means can be supported from their opposite ends without bending; and B. a car, said car including (1) a generally U-shaped rigid member having a top wall and a pair of depending splayed side walls straddling said track means, the splay angle of the side walls being substantially the same as the cant angle of the track means channels;

(2) a slide formed integrally with the rigid member top wall and extending substantially the entire length of that wall for attaching a marine fitting to said top wall;

(3) a plurality of donut-shaped, impact-resistant plastic wheels rotatively mounted to axles anchored in said rigid member side walls at the inboard surfaces thereof so that the wheels can engage in said channels, the peripheries of the wheels being rounded more or less in correspondence with the cross-sectional curvature of said track means upper and lower rails so that, when the car is moved along the track means under vertical or lateral loads transmitted through said slide, said wheels make line contacts with said upper or lower rails.

* * * * *